US008975987B2

(12) United States Patent
Kinpara et al.

(10) Patent No.: US 8,975,987 B2
(45) Date of Patent: Mar. 10, 2015

(54) TRANSMISSION LINE HAVING BAND-SHAPED RESISTORS CONNECTED TO OUTER SIDES OF GROUND ELECTRODES IN THE TRANSMISSION LINE

(75) Inventors: Yuhki Kinpara, Tokyo (JP); Toshio Kataoka, Tokyo (JP); Toru Takada, Hadano (JP)

(73) Assignees: Sumitomo Osaka Cement Co., Ltd. (JP); Toru Takada (JP)

( * ) Notice: Subject to any disclaimer, the term of this patent is extended or adjusted under 35 U.S.C. 154(b) by 0 days.

(21) Appl. No.: 14/122,900

(22) PCT Filed: May 31, 2012

(86) PCT No.: PCT/JP2012/064100

§ 371 (c)(1),
(2), (4) Date: Jan. 9, 2014

(87) PCT Pub. No.: WO2012/165557

PCT Pub. Date: Dec. 6, 2012

(65) Prior Publication Data

US 2014/0111291 A1 Apr. 24, 2014

(30) Foreign Application Priority Data

May 31, 2011 (JP) ..... P2011-122439

(51) Int. Cl.
*H01P 3/08* (2006.01)
*H01P 3/00* (2006.01)

(52) U.S. Cl.
CPC ..... *H01P 3/081* (2013.01); *H01P 3/006* (2013.01)
USPC ..... 333/246; 333/81 A

(58) Field of Classification Search
CPC ..... H01P 3/003; H01P 3/006; H01P 3/08; H01P 1/227
USPC ..... 333/238, 246, 81 A
See application file for complete search history.

(56) References Cited

U.S. PATENT DOCUMENTS 5,225,796 A * 7/1993 Williams et al. ..... 333/12
6,023,209 A * 2/2000 Faulkner et al. ..... 333/238

FOREIGN PATENT DOCUMENTS

JP A-06-085509 3/1994
JP A-06-224604 8/1994

(Continued)

OTHER PUBLICATIONS

International Search Report for corresponding International Patent Application No. PCT/JP2012/064100 (mailed Sep. 4, 2012).

(Continued)

*Primary Examiner* — Benny Lee
(74) *Attorney, Agent, or Firm* — Merchant & Gould P.C.

(57) ABSTRACT

Provided is a transmission line used to transmit high-frequency electrical signals which can remove a dip-shaped (S21) loss of transmission characteristics due to wall surface resonance, furthermore, can further decrease the size, and can suppress the manufacturing cost at a low level. The transmission line used to transmit high-frequency electrical signals (1) is made up of a signal line (3) used to transmit high-frequency electrical signals which is formed on a front surface (2*a*) of a dielectric substrate (2), GND electrodes (4) formed outside the signal line (3) and in vicinities of end portions of the front surface (2*a*), a GND electrode (6) that is electrically connected to the GND electrodes (4) through via holes (5) formed across an entire rear surface (2*b*) of the dielectric substrate (2), and band-shaped resistors (7) that are formed outside the GND electrodes (4) and in the end portions of the surface (2*a*) and are electrically connected to the GND electrodes (4).

4 Claims, 8 Drawing Sheets

(56) References Cited

FOREIGN PATENT DOCUMENTS

| | | |
|---|---|---|
| JP | A-2002-513226 | 5/2002 |
| JP | A-2005-039586 | 2/2005 |
| JP | A-2005-073225 | 3/2005 |
| JP | A-2005-236826 | 9/2005 |
| WO | WO 99/56338 A1 | 11/1999 |

OTHER PUBLICATIONS

Japanese Office Action for corresponding Japanese Patent Application No. 2011-122439 (mailed Jan. 8, 2013).

* cited by examiner

TRANSMISSION LINE HAVING BAND-SHAPED RESISTORS CONNECTED TO OUTER SIDES OF GROUND ELECTRODES IN THE TRANSMISSION LINE

This application is a U.S. National Stage Application under 35 U.S.C. §371 of International Patent Application No. PCT/JP2012/064100 filed 31 May 2012, which claims the benefit of priority to Japanese Patent Application No. 2011-122439 filed 31 May 2011, the disclosures of all of which are hereby incorporated by reference in their entireties. The International Application was published in Japanese on 6 Dec. 2012 as WO 2012/165557.

TECHNICAL FIELD

The present invention relates to a transmission line used to transmit high-frequency electrical signals, and particularly to a transmission line used to transmit high-frequency electrical signals in which the occurrence of wall surface resonance in an operation frequency range of high-frequency electrical signals has been removed.

BACKGROUND

Ordinary examples of a transmission line used to transmit high-frequency electrical signals of the related art which uses a frequency band of 20 GHz or more include a microstrip (MSW)-type transmission line that is called a microstrip line which is provided with a signal electrode used to transmit high-frequency electrical signals on a front surface (one principal surface) of a dielectric substrate and includes a GND electrode (ground electrode) formed on a rear surface (the other principal surface) and a coplanar (CPW)-type transmission line that is called a coplanar line which includes a signal electrode used to transmit high-frequency electrical signals and a GND electrode (ground electrode) formed on a front surface (one principal surface) of a dielectric substrate (refer to Japanese Unexamined Patent Application Publication No. 2005-73225 and Japanese Unexamined Patent Application Publication No. 2005-236826).

However, the microstrip (MSW)-type transmission line has a problem in that, since there is a limitation in the width and thickness of the GND electrode due to the thickness and permittivity of the substrate, and it is difficult to design the connection from other electrode patterns to the GND electrode, there is a limitation in the electrical connection with other components.

In addition, the coplanar (CPW)-type transmission line includes the signal electrode and the GND electrode formed on the front surface of the substrate, and therefore the coplanar-type transmission line can be easily connected with other components, and the impedance can be controlled using a gap (interval) between the signal electrode and the GND electrode, which leads to an advantage of a small limitation in design.

When the coplanar (CPW)-type transmission line is put into actual use, the substrate needs to be accommodated in a metal box for electromagnetic shield or protection. In this case, the bottom surface of the substrate being accommodated serves as a ground, and a grounded coplanar (GCPW)-type transmission line called a grounded coplanar line is formed.

In the GCPW-type transmission line, the influence of a metallic wall surface becomes significant, and a deterioration phenomenon occurs in which a dip-shaped (S21) loss of the transmission characteristics due to resonance in an operation frequency increases. Therefore, in order to prevent the occurrence of the above-described deterioration in an operation frequency range, different solutions have been proposed, including optimizing the location of the metallic wall, providing a number of via holes that electrically connect the ground surface of the coplanar (GCPW)-type transmission line and the ground surface on the bottom surface of the substrate, and the like.

CITATION LIST

Patent Literature

[PTL 1] Japanese Unexamined Patent Application Publication No. 2005-73225

[PTL 2] Japanese Unexamined Patent Application Publication No. 2005-236826

SUMMARY OF THE INVENTION

Technical Problem

Meanwhile, in the GCPW-type transmission lines of the related art, there was a problem in that the degree of freedom in design was significantly limited.

For example, in the proposal in which the location of the metallic wall was optimized in order to remove the dip-shaped (S21) loss of the transmission characteristics due to the wall surface resonance in the related art, there was a problem in that it was difficult to decrease the size of a high-frequency module including a circuit substrate accommodated in a metal box, and therefore it was difficult to realize a high-frequency module in a desired size.

In addition, in the proposal in which a number of via holes were provided, there were problems in that, since it was necessary to design the interval between the via holes and the interval between the via hole and the end portion of the GND electrode in a narrow range, there was a high probability that the transmission line would break due to a decrease in the strength of the substrate. In addition, since there were lower limit values for the interval between the via holes and the interval between the via hole and the end portion of the GND electrode, an additional decrease in the size of the structure was difficult to achieve.

In addition, there was another problem in that manufacturing time for the formation and plating of the via holes increased and the manufacturing cost increased.

The invention has been made to solve the above-described problems, and an object of the invention is to provide a transmission line used to transmit high-frequency electrical signals which can remove the dip-shaped (S21) loss of the transmission characteristics due to wall surface resonance. The invention may also decrease the size of the transmission line, and decrease the manufacturing cost thereof.

Solution to the Problem

As a result of comprehensive studies used to solve the above-described problems, the present inventors found that, when a signal line used to transmit high-frequency electrical signals and first ground electrodes are formed on one principal surface of a dielectric substrate, a second ground electrode that is electrically connected to the first ground electrodes is formed on the other principal surface, and band-shaped resistors are connected to the outside of the first ground electrodes in an electrical signal transmission direction of the signal line, the dip-shaped (S21) loss of the transmission characteristics due to wall surface resonance can be removed, and, furthermore, the manufacturing cost can be greatly reduced. Furthermore, the inventors found that, when the width of the band-shaped resistor is set to be equal to or larger than the width of the signal line, and the area resistance of the band-shaped resistor is set in a range of 5Ω/□ to 2 kΩ/□, it becomes easier to remove the dip-shaped (S21) loss of the transmission characteristics due to wall surface resonance, and, furthermore, it becomes easier to reduce the manufacturing cost of the device.

That is, according to the invention, there is provided a transmission line used to transmit high-frequency electrical signals that is produced by forming a signal line used to transmit high-frequency electrical signals and first ground electrodes on one principal surface of a dielectric substrate, forming a second ground electrode that is electrically connected to the first ground electrodes on the other principal surface, and connecting band-shaped resistors to the outside of the first ground electrodes in an electrical signal transmission direction of the signal line.

In the GCPW-type transmission line of the related art, in addition to principal electric waves propagating in the signal line in the transmission direction, weak electric waves propagating toward both side walls in the perpendicular direction to the signal line are generated. The electric waves toward the side walls are reflected by side wall surfaces. The reflected waves then return to the signal line, interfere with the principal electric waves propagating in the transmission direction so as to cause resonance at a certain frequency, thereby causing a dip-shaped (S21) loss of the transmission characteristics.

In the transmission line used to transmit high-frequency electrical signals of the invention, when the signal line and the first ground electrodes are formed on one principal surface of the dielectric substrate, the second ground electrode that is electrically connected to the first ground electrodes is formed on the other principal surface, and the band-shaped resistors are connected to the outside of the first ground electrodes in an electrical signal transmission direction of the signal line, the band-shaped resistors absorb the weak electric waves propagating from the signal line in the dielectric substrate toward the side wall surfaces so that the electric waves arriving at the side walls weaken. In addition, the reflected electric waves that have been reflected by the side walls and move toward the signal line are also, again, absorbed by the band-shaped resistors. Then, the interference between the principal electric waves propagating in the transmission direction and the reflected electric waves from the side walls is decreased such that the interference is negligible, and the occurrence of the deterioration phenomenon of the dip-shaped (S21) loss due to resonance is diminished.

In the transmission line used to transmit high-frequency electrical signals of the invention, a width of the band-shaped resistor is set to be equal to or larger than the width of the signal line, and the area resistance of the band-shaped resistor is set to be in a range of 5Ω/□ to 2 kΩ/□.

In the transmission line used to transmit high-frequency electrical signals, the deterioration phenomenon of the dip-shaped (S21) loss due to resonance is eliminated by regulating the width and area resistance of the band-shaped resistor.

In the transmission line used to transmit high-frequency electrical signals of the invention, a second band-shaped resistors are connected to the outside of the second ground electrode in an electrical signal transmission direction of the signal line.

In the transmission line used to transmit high-frequency electrical signals, it becomes possible to further remove the dip-shaped (S21) loss of the transmission characteristics due to wall surface resonance by connecting the second band-shaped resistors to the outside of the second ground electrode in the electrical signal transmission direction of the signal line.

Advantageous Effects of the Invention

According to the transmission line for high-frequency electrical signals of the invention, since the signal line used to transmit high-frequency electrical signals and the first ground electrodes are formed on one principal surface of the dielectric substrate, the second ground electrode that is electrically connected to the first ground electrodes is formed on the other principal surface, and the band-shaped resistors are connected to the outside of the first ground electrodes in an electrical signal transmission direction of the signal line, it is possible to decrease the interference between the principal electric waves propagating in the transmission direction and the reflected electric waves from the wall surface such that the interference is negligible. Therefore, it is possible to prevent the occurrence of the deterioration phenomenon of the dip-shaped (S21) loss due to resonance.

The transmission line used to transmit high-frequency electrical signals can work appropriately by adding a simple step of forming the band-shaped resistor so as to be connected to the first ground electrode.

In addition, since the band-shaped resistors are formed on one principal surface of the dielectric substrate so as to be connected to the first ground electrodes, there is no limitation in decreasing the size of the transmission line due to the size of the band-shaped resistor, and there is no concern that the substrate strength of the dielectric substrate may decrease.

In addition, the configuration in which the band-shaped resistors are connected to the outside of the first ground electrodes in the electrical signal transmission direction of the signal line enables the band-shaped resistors to efficiently absorb the currents of standing waves being generated on one principal surface of the dielectric substrate.

In addition, the configuration in which the second band-shaped resistors are connected to the outside of the second ground electrode in the electrical signal transmission direction of the signal line makes it easier to remove the dip-shaped (S21) loss of the transmission characteristics due to wall surface resonance.

BRIEF DESCRIPTION OF THE DRAWINGS

In FIGS. 4, 5, and 7-13, lines referred to as "S21" indicate loss of the transmission characteristics of the electrical signal by illustrating the degree of transmission.

In FIGS. 4, 5 and 7-13, lines referred to as "S11" indicate loss of the transmission characteristics of the electrical signal by illustrating the degree of reflection.

In FIGS. 4, 5 and 7-13, intensity of the electrical signal is shown along the vertical axis in units of dB as a function of frequency, which is shown along the horizontal axis in units of GHz.

DETAILED DESCRIPTION OF THE PREFERRED EMBODIMENTS

Embodiments which carry out the transmission line used to transmit high-frequency electrical signals of the invention will be described.

Meanwhile, the embodiments are intended to specifically describe the invention in order to better understand of the purpose of the invention, and do not limit the invention unless otherwise particularly specified.

First Embodiment

Figure 1:
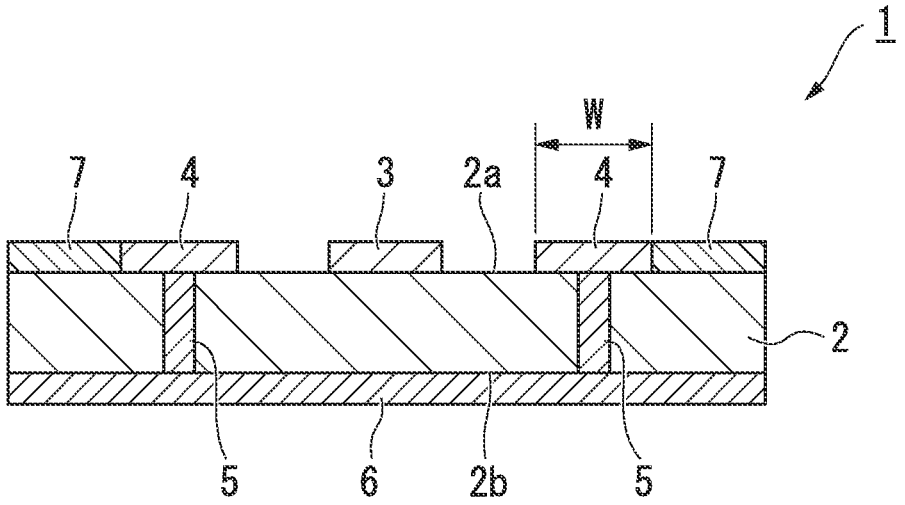
FIG. 1 is a cross-sectional view of a GCPW-type transmission line used to transmit high-frequency electrical signals according to a first embodiment of the invention.

FIG. 1 is a cross-sectional view of a GCPW-type transmission line used to transmit high-frequency electrical signals according to a first embodiment of the invention, and illustrates a transmission line that can deal with high-frequency electrical signals having frequencies of 20 GHz or higher. In the drawing, reference sign 1 represents a GCP-type transmission line used to transmit high-frequency electrical signals, in which a signal line 3 used to transmit high-frequency electrical signals is formed on a front surface (one principal surface) 2*a* of a dielectric substrate 2, GND electrodes (first ground electrodes) 4 having width W are formed outside the signal line 3 and in vicinities of end portions of the front surface 2*a*, and a GND electrode (second ground electrode) 6 that is electrically connected to the GND electrodes 4 through via holes 5 is formed across an entire rear surface (the other principal surface) 2*b* of the dielectric substrate 2.

In addition, band-shaped resistors 7 that are electrically connected to the GND electrodes 4 are formed outside the GND electrodes 4 and in the end portions of the front surface 2*a*.

Here, the dielectric substrate 2 is preferably a ceramic substrate having a high thermal conductivity and excellent electrical insulation properties, and, for example, an alumina ($Al_2O_3$) substrate, an aluminum nitride (AlN) substrate, a silicon nitride ($Si_3N_4$) substrate or the like can be selectively used depending on the purpose or use. Particularly, as the substrate for transmission lines used to transmit high-frequency electrical signals, an alumina ($Al_2O_3$) substrate is preferable.

The signal line 3 is formed of a conductive material, and configures a part of the transmission line used to transmit high-frequency electrical signals. Examples of the conductive material include a metal made of one selected from gold (Au), chromium (Cr), nickel (Ni), palladium (Pd), titanium (Ti), aluminum (Al), copper (Cu) and the like and an alloy containing two or more metals.

Examples of the alloy include a gold-chromium (Au—Cr) alloy, a gold-nichrome (Au—NiCr) alloy, a gold-nichrome-palladium (Au—NiCr—Pd) alloy, a gold-palladium-titanium (Au—Pd—Ti) alloy, and the like.

The GND electrodes 4 and 6 and the via holes 5 are, similarly to the signal line 3, formed using an ordinary conductive material, and configure a part of the transmission line used to transmit high-frequency electrical signals. Examples of the conductive material include the same metals and alloys as used to form the signal line 3.

The band-shaped resistors 7 are formed in the electrical signal transmission direction (a direction perpendicular to the surface of paper in FIG. 1) of the GND electrodes 4. Thereby, the band-shaped resistors can efficiently absorb the currents of standing waves being generated on the front surface 2*a* of the dielectric substrate 2.

The width of the band-shaped resistor 7 is equal to or larger than the width of the signal line 3, and the area resistance (sheet resistance) of the band-shaped resistor 7 is preferably in a range of 5Ω/□ to 2 kΩ/□.

When the width and area resistance (sheet resistance) of the band-shaped resistor 7 are set in the above-described range, the occurrence of the deterioration phenomenon called the dip-shaped (S21) loss due to resonance is diminished.

Examples of a material for the band-shaped resistor include tantalum-based materials such as tantalum nitride ($Ta_2N$), tantalum-silicon (Ta—Si), tantalum-silicon carbide (Ta—SiC) and tantalum-aluminum-nitrogen (Ta—Al—N); chromium-based materials such as nichrome (NiCr) and nichrome-silicon (NiCr—Si); ruthenium-based materials such as ruthenium oxide-ruthenium (Ru—RuO); and the like.

Only one material in the examples may be solely used, or a material containing two or more materials in the examples may be used. Particularly, when two materials for the band-shaped resistor having different area resistances are used, a desired area resistance can be easily obtained, which is preferable.

Particularly, tantalum nitride ($Ta_2N$) is a material for the band-shaped resistor having an area resistance (sheet resistance) in a range of approximately 20Ω/□ to 150Ω/□, and is a more preferable material for reasons of an extremely small change in the resistance value over time due to a protective film formed by cathode oxidation, and the like.

The band-shaped resistors 7 can be formed by forming the signal line 3 and the GND electrodes 4 using an apparatus used to form thin films, such as a deposition apparatus or a sputtering apparatus, and a conductive material, and then forming a pattern using a mask having the pattern of the band-shaped resistor 7 and a material for the band-shaped resistor. The method can be carried out by slightly improving a manufacturing step of the related art, and therefore it is possible to use the manufacturing step of the related art with no significant change, and an increase in the manufacturing cost can also be significantly limited.

According to the transmission line 1 for high-frequency electrical signals of the present embodiment, since the signal line 3 used to transmit high-frequency electrical signals is formed on the front surface 2*a* of the dielectric substrate 2, the GND electrodes 4 are formed outside the signal line 3 and in the vicinity of the end portions of the front surface 2*a*, the GND electrode 6 that is electrically connected to the GND electrodes 4 through the via holes 5 is formed on the rear surface 2*b* of the dielectric substrate 2, and the band-shaped resistors 7 that are electrically connected to the GND electrodes 4 are formed outside the GND electrodes 4 and in the end portions of the front surface 2*a*, it is possible to absorb the currents of the standing waves at operation frequencies of high-frequency electrical signals which are generated on the front surface 2*a* of the dielectric substrate 2 using the band-shaped resistors 7. Therefore, it is possible to decrease the interference between the principal electric waves propagating in the transmission direction and the reflected electric waves from the wall surface such that the interference is negligible, and it is possible to prevent the occurrence of the deterioration phenomenon of the dip-shaped (S21) loss due to resonance.

In addition, since the band-shaped resistors 7 are formed outside the GND electrodes 4 and in the end portions of the front surface 2*a* of the dielectric substrate 2 so as to be electrically connected to the GND electrodes 4, it is possible to design the shape and size of the band-shaped resistors 7 depending on the shapes and sizes of the dielectric substrate 2 and the GND electrodes 4, and there is no case in which the shape and size of the transmission line 1 used to transmit high-frequency electrical signals are limited due to the shape and size of the band-shaped resistor 7.

In addition, the band-shaped resistor 7 can be formed easily and cheaply by slightly improving the manufacturing step of the related art. Therefore, it is also possible to significantly limit an increase in the manufacturing cost.

Second Embodiment

Figure 2:
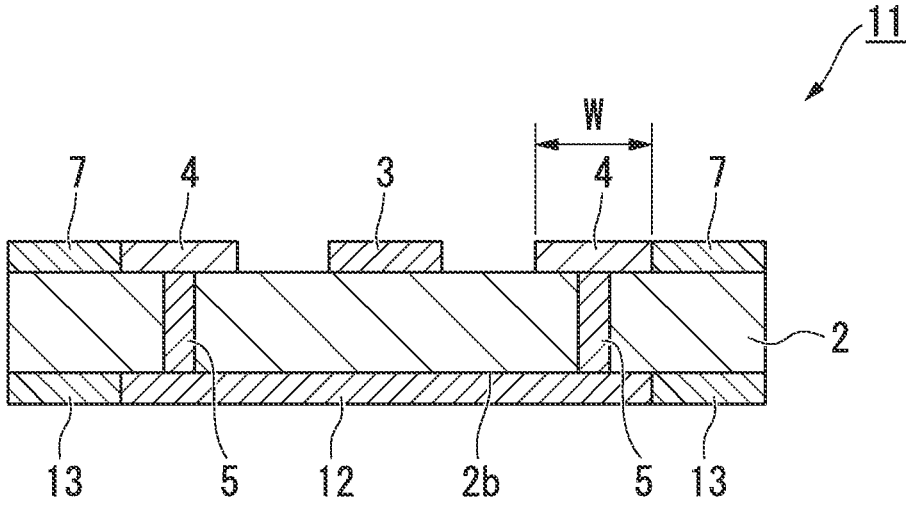
FIG. 2 is a cross-sectional view of a GCPW-type transmission line used to transmit high-frequency electrical signals according to a second embodiment of the invention.

FIG. 2 is a cross-sectional view of a GCPW-type transmission line used to transmit high-frequency electrical signals according to a second embodiment of the invention, and the differences of the transmission line 11 used to transmit high-frequency electrical signals of the present embodiment from the transmission line 1 used to transmit high-frequency electrical signals of the first embodiment are as follows. While the GND electrode 6 in the first embodiment is formed across the entire rear surface 2*b* of the dielectric substrate 2 in the transmission line 1 used to transmit high-frequency electrical signals, in the transmission line 11 used to transmit high-frequency electrical signals of the second embodiment, a GND electrode (second ground electrode) 12 that has a smaller area than the GND electrode 6 in the first embodiment and is electrically connected to the GND electrodes 4 (having width W) through the via holes 5 is formed on the rear surface 2*b* of the dielectric substrate 2, and (second) band-shaped resistors 13 that are electrically connected to the GND electrode 12 are formed outside the GND electrode 12 and in the end portions of the rear surface 2*b*. Except for what has been described above, the transmission line used to transmit high-frequency electrical signals of the second embodiment has the same components as in the transmission line 1 used to transmit high-frequency electrical signals of the first embodiment.

Similar to the band-shaped resistor 7, the width of the band-shaped resistor 13 is equal to or larger than the width of the signal line 3, and the area resistance of the band-shaped resistor 13 is preferably in a range of 5Ω/□ to 2 kΩ/□.

When the width and area resistance of the band-shaped resistor 13 are set in the above-described range, similar to the band-shaped resistor 7, the occurrence of the deterioration phenomenon called the dip-shaped (S21) loss due to resonance is diminished.

Since the material used to form the band-shaped resistor is the same as that used to form the band-shaped resistor 7, the material will not be described here.

Similar to the band-shaped resistor 7, the band-shaped resistor 13 is also formed in the electrical signal transmission direction (a direction perpendicular to the surface of paper in FIG. 2) of the GND electrode 12.

As such, in the transmission line 11 used to transmit high-frequency electrical signals of the second embodiment, since the currents of standing waves being generated on the front surface 2*a* of the dielectric substrate 2 are efficiently absorbed using the band-shaped resistors 7, and the currents of standing waves being generated on the front surface 2*b* of the dielectric substrate 2 are efficiently absorbed using the band-shaped resistors 13, it is possible to efficiently absorb the currents of standing waves being generated in the dielectric substrate 2.

The transmission line 11 used to transmit high-frequency electrical signals of the second embodiment can also exhibit the same actions and effects as in the transmission line 1 used to transmit high-frequency electrical signals of the first embodiment.

Furthermore, since the GND electrode 12 is formed on the rear surface 2*b* of the dielectric substrate 2, and the band-shaped resistors 13 that are electrically connected to the GND electrode 12 are formed outside the GND electrode 12 and in the end portions of the rear surface 2*b*, it is possible to efficiently absorb the currents of standing waves being generated in the dielectric substrate 2 using the band-shaped resistors 7 and the band-shaped resistors 13.

EXAMPLES

Hereinafter, the invention will be specifically described using an example and a conventional example, but the invention is not limited to the examples.

Conventional Example

Figure 3:
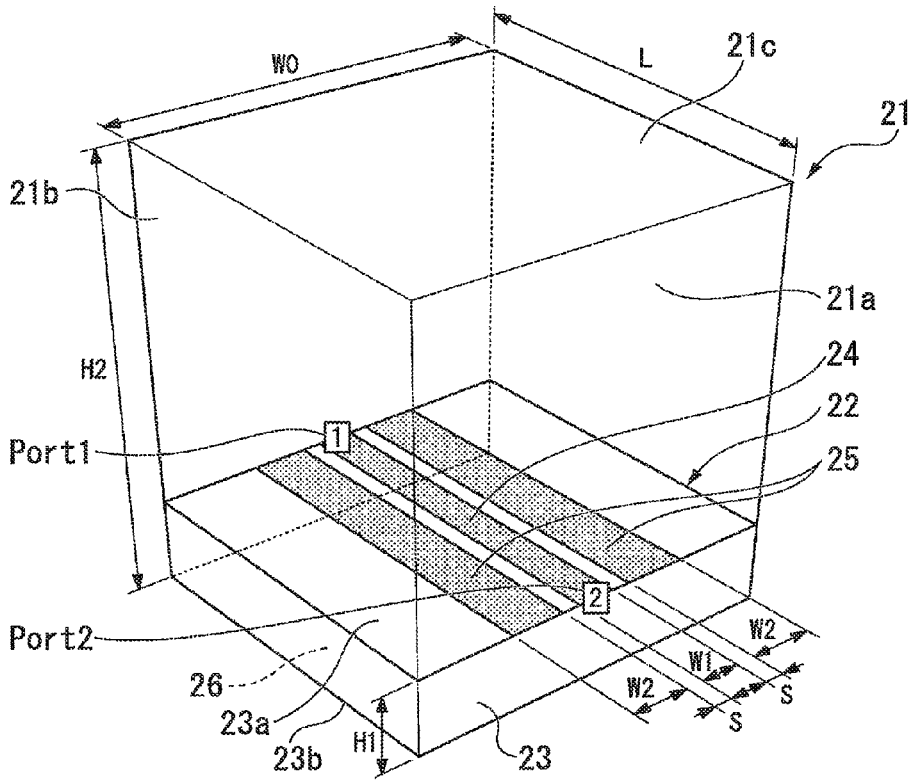
FIG. 3 (PRIOR ART)
FIG. 3 is a perspective view illustrating a conventional GCPW-type transmission line used to transmit high-frequency electrical signals.

FIG. 3 is a view illustrating a conventional GCPW-type transmission line used to transmit high-frequency electrical signals (hereinafter, referred to shortly as GCPW-type transmission line) formed in a hexahedral metal box filled with air. In the drawing, reference sign 21 represents the metal box, and has a hexahedral structure formed by assembling metallic walls 21*a*, 21*b*, 21*c*, . . . in a box shape.

In addition, reference sign 22 represents the GCPW-type transmission line, a signal line 24 used to transmit high-frequency electrical signals is formed on a front surface 23*a* of a dielectric substrate 23, GND electrodes (first ground electrodes) 25 are formed outside the signal line 24, and a GND electrode (second ground electrode) 26 that is electrically connected to the GND electrodes 25 is formed across an entire rear surface 23*b* of the dielectric substrate 23.

Here, Port 1 represents a terminal that applies high-frequency signals, and Port 2 represents a terminal that measures the intensity of signals being transmitted.

On the conventional GCPW-type transmission line, a three-dimensional electromagnetic field simulation of a resonance occurrence phenomenon was carried out. Here, regarding the shape parameter of the conventional GCPW-type transmission line 22, when the lengths of the GCPW-type transmission line 22 and the metal box 21 were represented by L, the width of the GCPW-type transmission line 22 and the metal box 21 were represented by $W_0$, the width of the signal line 24 made of a thin metallic film was represented by $W_1$, the widths of the first GND electrode 25 made of a thin metallic film were represented by $W_2$, the distances between the signal line 24 and the first GND electrodes 25 were represented by S, the height of the dielectric sheet 23 was represented by $H_1$, and the height of the metal box 21 was represented by $H_2$, L was set to 2.0 mm, $W_0$ was set to 2.1 mm, $W_1$ was set to 0.2 mm, $W_2$ was set to 0.3 mm, S was set to 0.1 mm, $H_1$ was set to 0.5 mm, and $H_2$ was set to 2.5 mm. The signal source impedance at Port 1 and the load impedance at Port 2 were set to 50Ω, and an alumina sheet ($Al_2O_3$: 99.8% by mass) having a relative permittivity of 9.9 and a dielectric loss of 0.0001 was used as the dielectric substrate 23. Meanwhile, the resistivity at the metallic walls 21*a*, 21*b*, 21*c*, . . . and the signal line 24 was set to 0.

Figure 4:
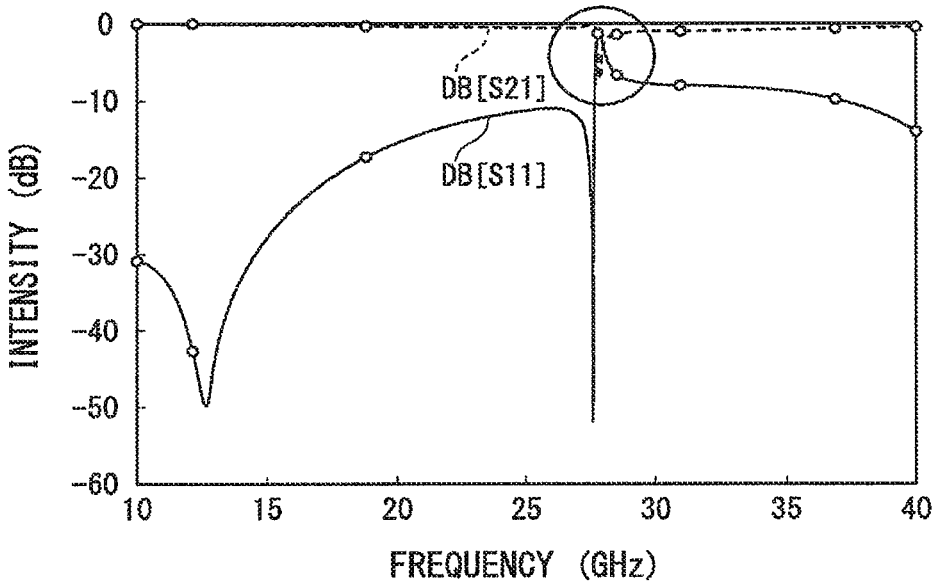
FIG. 4 (PRIOR ART)
FIG. 4 is a view illustrating a computation result using a three-dimensional electromagnetic field simulation of the conventional GCPW-type transmission line.

FIG. 4 is a view showing a computation result (S parameter) using the three-dimensional electromagnetic field simulation of the conventional GCPW-type transmission line, and is a computation result of a dip-shaped (S21) loss of the transmission characteristics illustrating the degree of transmission from Port 1 to Port 2 in FIG. 3 and a dip-shaped (S11) loss of the transmission characteristics illustrating the degree of reflection to Port 1 using the three-dimensional electromagnetic field simulator. According to FIG. 4, deterioration due to the dip-shaped (S21) loss was observed in the vicinity of 28 GHz.

Figure 5:
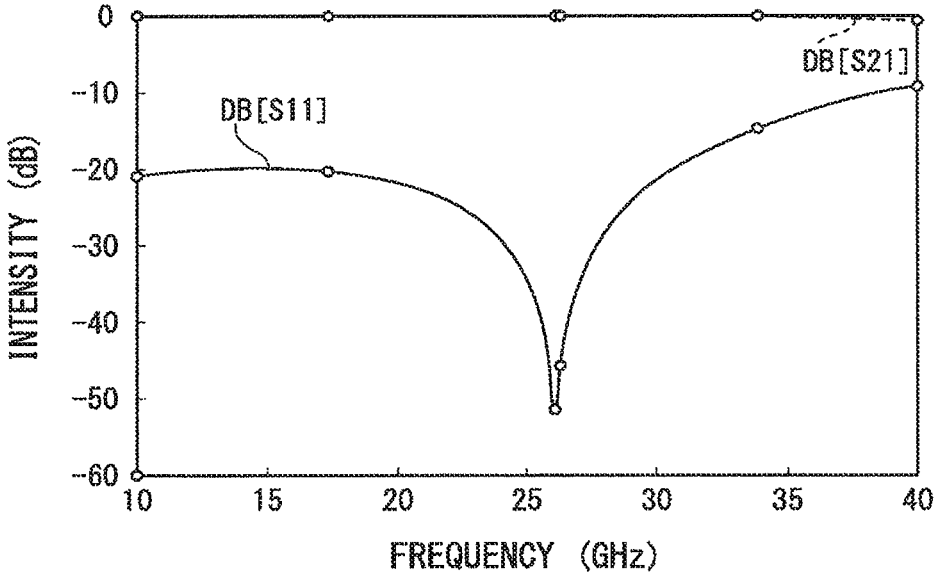
FIG. 5 (PRIOR ART)
FIG. 5 is a view illustrating a further computation result using the three-dimensional electromagnetic field simulation of the conventional GCPW-type transmission line.

FIG. 5 is a view showing a further computation result (S parameter) using the three-dimensional electromagnetic field simulation of the conventional GCPW-type transmission line, and is a computation result of the three-dimensional electromagnetic field simulator in a case in which L was set to 1.0 mm, and the other parameters were set in the same manner as in the conventional transmission line. According to FIG. 5, deterioration due to the dip-shaped (S21) loss was not observed.

Example

Figure 6:
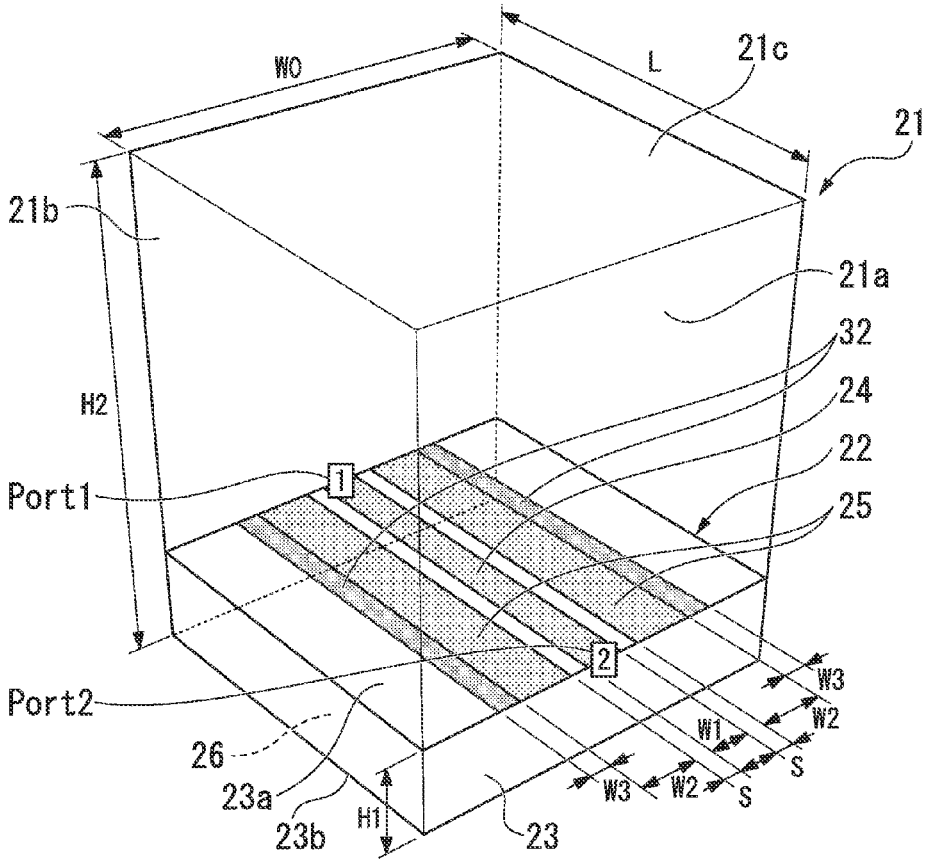
FIG. 6 is a perspective view illustrating a GCPW-type transmission line used to transmit high-frequency electrical signals of an example of the invention.

FIG. 6 is a view showing a GCPW-type transmission line of the present example formed in a hexahedral metal box filled with air, and a difference from the conventional GCPW-type transmission line of FIG. 3 is that band-shaped resistors 32 made of a thin metal film were connected to the outside of the first GND electrodes 25 in the transmission line direction.

Here, the widths of the band-shaped resistors 32 were represented by $W_3$, and the sheet resistance was represented by $R_{se}$ (Ω/□). The other symbols and reference numerals in FIG. 6 are identified below in the Reference Signs List.

Figure 7:
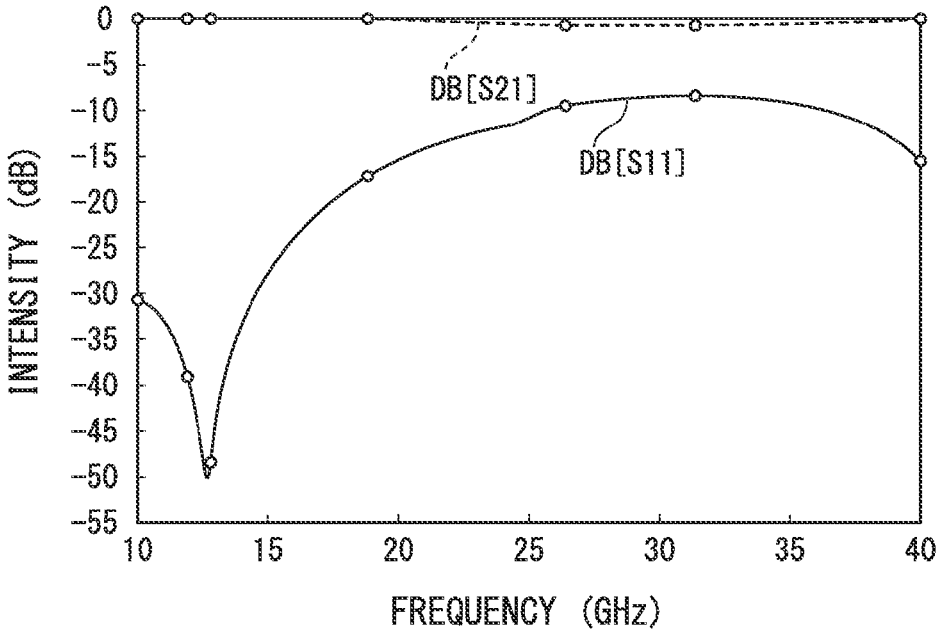
FIG. 7 is a view illustrating a computation result using a three-dimensional electromagnetic field simulation of the GCPW-type transmission line of the example of the invention.

FIG. 7 is a view showing a computation result (S parameter) using the three-dimensional electromagnetic field simulation of the GCPW-type transmission line of the example, and is a computation result of the three-dimensional electromagnetic field simulator in a case in which $W_3$ and $W_1$ were set to 0.2 mm, $R_{se}$ was set to 50Ω/□, and the other parameters were set in the same manner as used to generate the computation result in FIG. 4 using the conventional transmission line. In FIG. 7, it was observed that deterioration due to the dip-shaped (S21) loss was eliminated in the vicinity of 28 GHz compared with FIG. 4.

Next, the critical width of $W_3$ in a case in which $R_{se}$ was set to 50Ω/□ was investigated.

Figure 8:
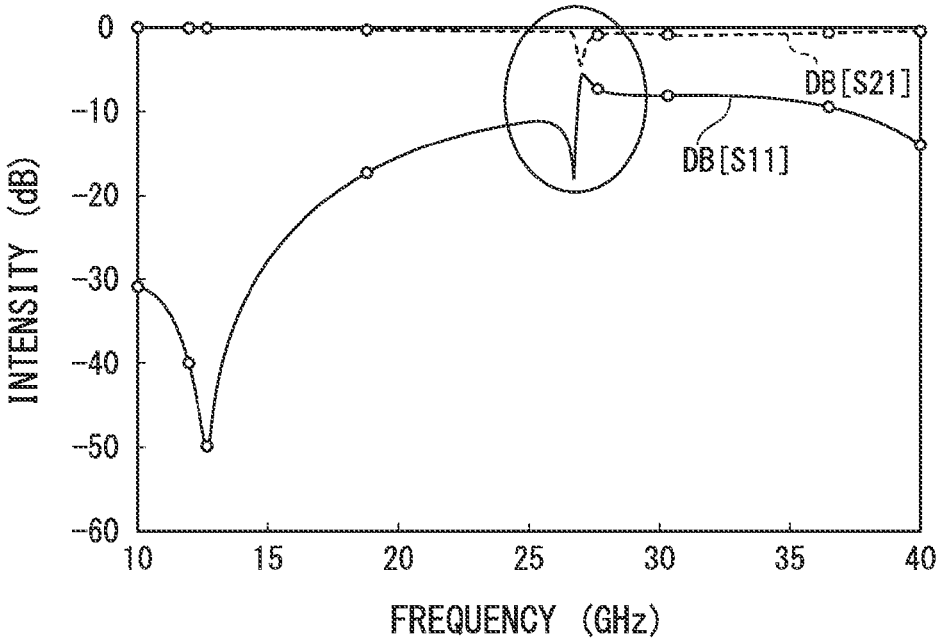
FIG. 8 is a view illustrating a further computation result using the three-dimensional electromagnetic field simulation of the GCPW-type transmission line of the example of the invention.

FIG. 8 is a view showing a further computation result (S parameter) using the three-dimensional electromagnetic field simulation of the GCPW-type transmission line of the example, and is a computation result of the three-dimensional electromagnetic field simulator in a case in which $W_3$ was set to 0.05 mm, and the other parameters were set in the same manner as used to generate the computation result in FIG. 7.

Figure 9:
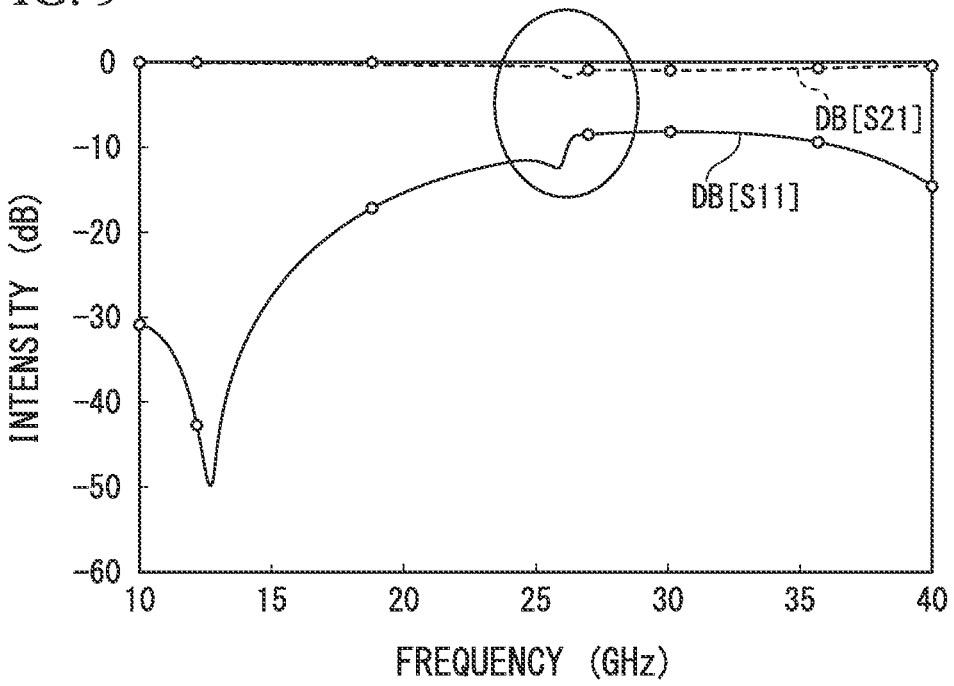
FIG. 9 is a view illustrating yet a further computation result using the three-dimensional electromagnetic field simulation of the GCPW-type transmission line of the example of the invention.

FIG. 9 is a view showing yet a further computation result (S parameter) using the three-dimensional electromagnetic field simulation of the GCPW-type transmission line of the example, and is a computation result of the three-dimensional electromagnetic field simulator in a case in which $W_3$ was set to 0.10 mm, and the other parameters were set in the same manner as used to generate the computation result in FIG. 7.

Figure 10:
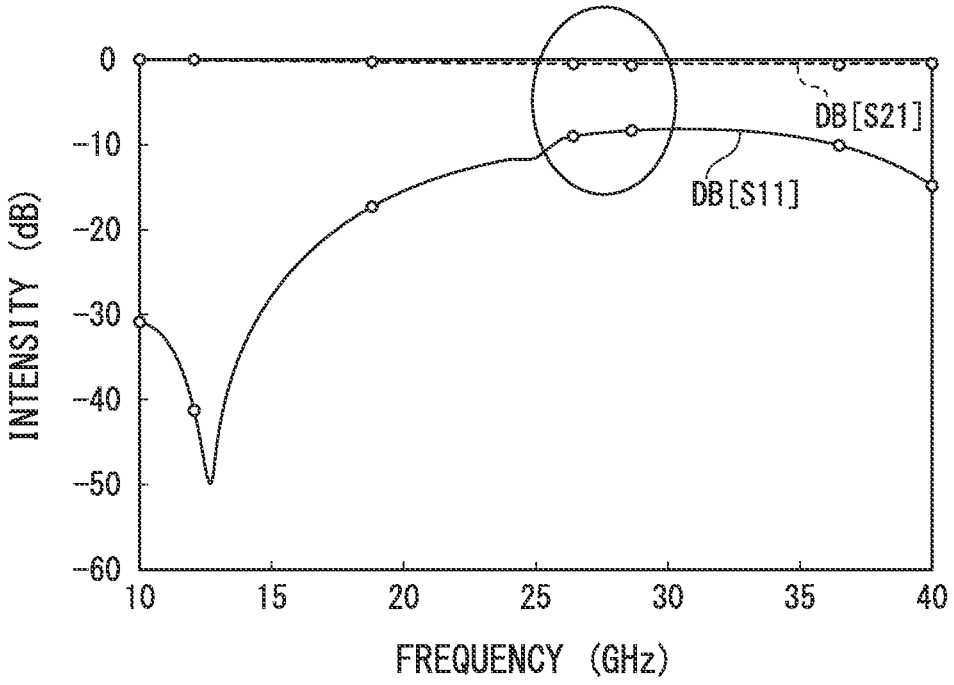
FIG. 10 is a view illustrating yet a further computation result using the three-dimensional electromagnetic field simulation of the GCPW-type transmission line of the example of the invention.

FIG. 10 is a view showing yet a further computation result (S parameter) using the three-dimensional electromagnetic field simulation of the GCPW-type transmission line of the example, and is a computation result of the three-dimensional electromagnetic field simulator in a case in which $W_3$ was set to 0.15 mm, and the other parameters were set in the same manner as used to generate the computation result in FIG. 7.

Figure 11:
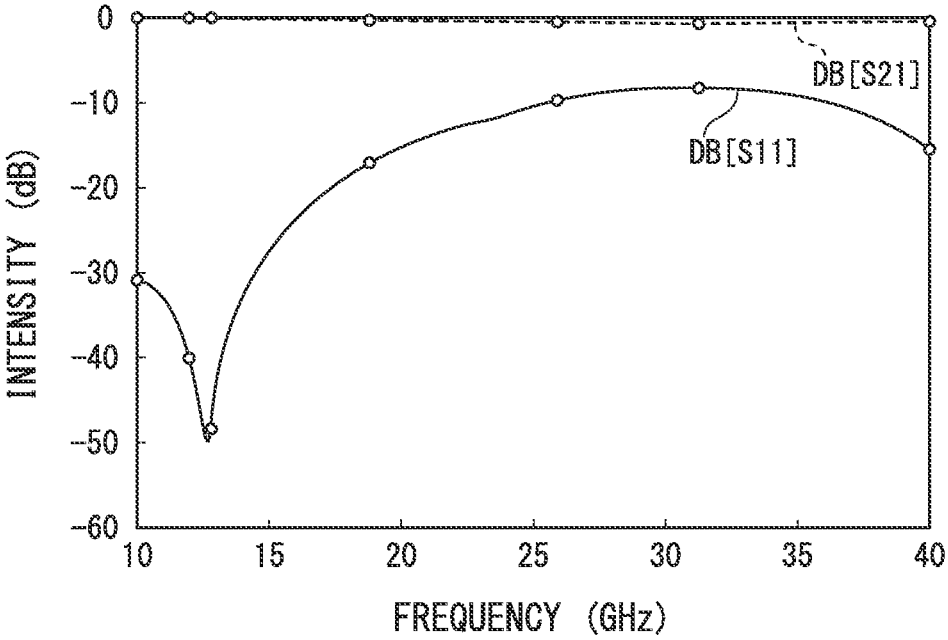
FIG. 11 is a view illustrating yet a further computation result using the three-dimensional electromagnetic field simulation of the GCPW-type transmission line of the example of the invention.

FIG. 11 is a view showing yet a further computation result (S parameter) using the three-dimensional electromagnetic field simulation of the GCPW-type transmission line of the example, and is a computation result of the three-dimensional electromagnetic field simulator in a case in which $W_3$ was set to 0.25 mm, and the other parameters were set in the same manner as used to generate the computation result in FIG. 7.

When the computation results (S parameters) shown in FIGS. 7-11 of the example were compared, the following was found.

It was found that, in FIG. 8, while there was a deterioration phenomenon due to the dip-shaped (S21) loss, as the $W_3$ value increased, the depth of the dip decreased, in a case in which $W_3$ was 0.2 mm, that is, $W_3$ and $W_1$ were 0.2 mm, the deterioration phenomenon due to the dip-shaped (S21) loss was almost completely removed, and, in a case in which $W_3>W_1$ was satisfied, the deterioration due to the dip-shaped (S21) loss was not observed.

From what has been described above, it was found that the critical width of $W_3$ for the deterioration due to the dip-shaped (S21) loss to be removed in a case in which $R_{se}$ was set to 50Ω/□ was approximately $W_1$ ($W_3=W_1$). Therefore, it was found that, in a region in which $W_3=W_1$ is satisfied, it is possible to prevent the occurrence of the deterioration phenomenon due to the dip-shaped (S21) loss regardless of the shape parameter.

Next, the critical width of $W_3$ in a case in which the value of $R_{se}$ had been changed was investigated.

As a result of computation using the three-dimensional electromagnetic field simulation, it was found that the critical width of $W_3$ becomes $W_1$ ($W_3=W_1$) in a certain range of $R_{se}$ regardless of the value of $R_{se}$.

Figure 12:
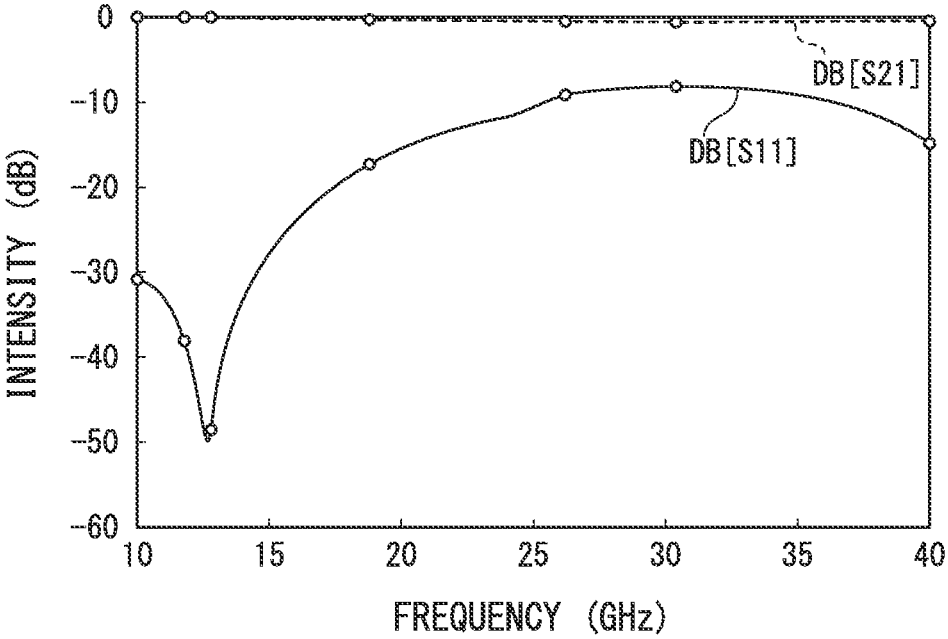
FIG. 12 is a view illustrating a computation result of the three-dimensional electromagnetic field simulation in a case in which $R_{se}$ of the GCPW-type transmission line of the example of the invention is set to 100Ω/□.
Figure 13:
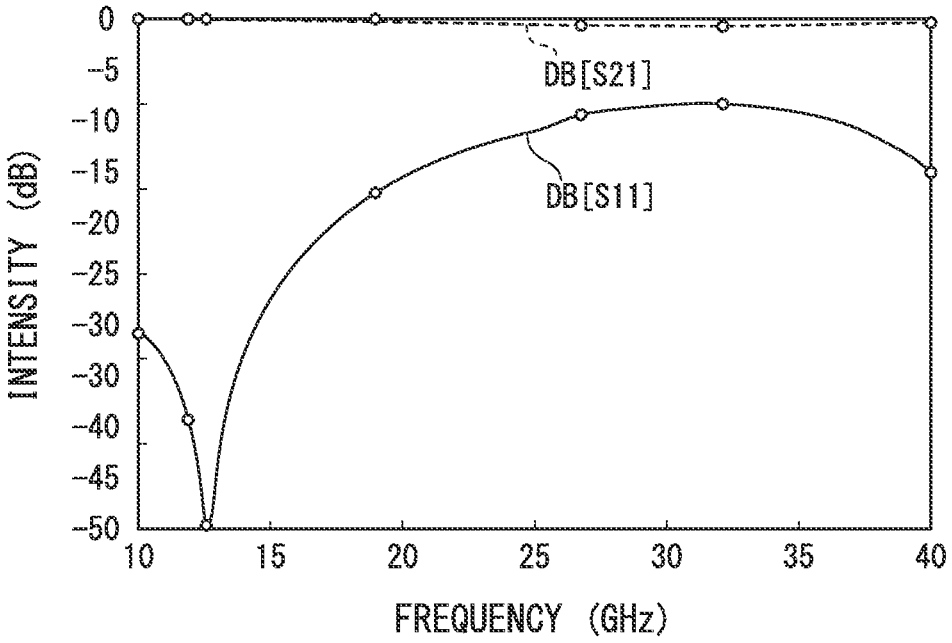
FIG. 13 is a view illustrating a computation result of the three-dimensional electromagnetic field simulation in a case in which $R_{se}$ of the GCPW-type transmission line of the example of the invention is set to 25Ω/□.

FIG. 12 shows a computation result (S parameter) of the three-dimensional electromagnetic field simulation in a case in which the critical width $W_3$ and $W_1$ were 0.2 mm when $R_{se}$ was set to 100Ω/□, and FIG. 13 illustrates a computation result (S parameter) of the three-dimensional electromagnetic field simulation in a case in which the critical width $W_3$ and $W_1$ were 0.2 mm when $R_{se}$ was set to 25Ω/□.

According to FIGS. 12 and 13, it was found that the deterioration due to the dip-shaped (S21) loss was not observed.

Furthermore, as a result of computation using the same three-dimensional electromagnetic field simulation, it was found that the upper limit threshold value used to remove the deterioration due to the dip-shaped (S21) loss at $R_{se}$ was 2 kΩ/□, and the lower limit threshold value was 5Ω/□.

Therefore, when the band-shaped resistors 32 made of a thin metallic film are connected to the outside of the GND electrodes 25 in the transmission line direction, the widths of the band-shaped resistors 32 are set to be equal to or larger than the width of the signal line 24, and the area resistance of the band-shaped resistors 32 are set to be a value in a range of 5Ω/□ to 2 kΩ/□, it is possible to remove the dip-shaped (S21) loss of the transmission characteristics due to wall surface resonance.

INDUSTRIAL APPLICABILITY

The transmission line used to transmit high-frequency electrical signals can be applied to transmission lines used to transmit high-frequency electrical signals, particularly to transmission lines used to transmit high-frequency electrical signals in which the occurrence of wall surface resonance in an operation frequency range of high-frequency electrical signals has been eliminated.

REFERENCE SIGNS LIST

1 TRANSMISSION LINE USED TO TRANSMIT HIGH-FREQUENCY ELECTRICAL SIGNALS
2 DIELECTRIC SUBSTRATE
2*a* FRONT SURFACE (ONE PRINCIPAL SURFACE)
2*b* REAR SURFACE (THE OTHER PRINCIPAL SURFACE)
3 SIGNAL LINE
4 GND ELECTRODE (FIRST GROUND ELECTRODE)
5 VIA HOLE
6 GND ELECTRODE (SECOND GROUND ELECTRODE)
7 BAND-SHAPED RESISTOR
11 TRANSMISSION LINE USED TO TRANSMIT HIGH-FREQUENCY ELECTRICAL SIGNALS
12 GND ELECTRODE (SECOND GROUND ELECTRODE)
13 BAND-SHAPED RESISTOR
21 METAL BOX, HAVING WIDTH $W_0$, LENGTH L, AND HEIGHT $H_2$
21*a*, 21*b*, 21*c* METALLIC WALL
22 GCPW-TYPE TRANSMISSION LINE
23 DIELECTRIC SUBSTRATE
23*a* FRONT SURFACE
23*b* REAR SURFACE
24 SIGNAL LINE, HAVING WIDTH $W_1$
25 GND ELECTRODE (FIRST GROUND ELECTRODE), HAVING WIDTH $W_2$ AND AT DISTANCE S FROM SIGNAL LINE 24
26 GND ELECTRODE (SECOND GROUND ELECTRODE), HAVING HEIGHT $H_1$
32 BAND-SHAPED RESISTOR
Port 1 TERMINAL THAT APPLIES HIGH-FREQUENCY SIGNALS
Port 2 TERMINAL THAT MEASURES INTENSITY OF SIGNALS BEING TRANSMITTED

We claim:

1. A transmission line used to transmit high-frequency electrical signals, comprising:

a signal line used to transmit high-frequency electrical signals therethrough;

a pair of first ground electrodes formed on one principal surface of a dielectric substrate, each of said pair of first ground electrodes comprising an inner side facing the signal line and an outer side;

a second ground electrode formed on the other principal surface of the dielectric substrate, that is electrically connected to the pair of first ground electrodes and comprises two sides facing away from the signal line;

a first band-shaped resistor oriented along the signal line and connected to the outer side of one of the pair of the first ground electrodes;

a second band-shaped resistor oriented along the signal line and connected to the outer side of the other of the pair of the first ground electrodes;

a third band-shaped resistor oriented along the signal line and connected to one of said sides of said second ground electrode; and a fourth band-shaped resistor oriented along the signal line and connected to the other of said sides of said second ground electrode.

2. The transmission line used to transmit high-frequency electrical signals according to claim 1, wherein a width of each of said first, second, third and fourth band-shaped resistors is set to be equal to or larger than a width of the signal line, and an area resistance of each of said first, second, third, and fourth band-shaped resistors is set in a range of 5Ω/□ to 2 kΩ/□.

3. The transmission line used to transmit high-frequency electrical signals according to claim 1, wherein a width of each of said first, second, third and fourth band-shaped resistors is larger than a width of the signal line.

4. The transmission line used to transmit high-frequency electrical signals according to claim 1, wherein an available frequency band of the transmission line is up to 40 GHz.

* * * * *